US006172292B1

(12) United States Patent
Dimbath

(10) Patent No.: US 6,172,292 B1
(45) **Date of Patent: *Jan. 9, 2001**

(54) PROTECTIVE COVER FOR USE WITH A STRINGED MUSICAL INSTRUMENT

(76) Inventor: Wolfgang Dimbath, Werner-von-Siemens-Strasse 14, 91056 Erlangen (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/030,369

(22) Filed: Feb. 25, 1998

(30) Foreign Application Priority Data

Feb. 26, 1997 (DE) ..... 197 07 688

(51) Int. Cl.[7] ..... G10G 3/00
(52) U.S. Cl. ..... 84/453; 84/181
(58) Field of Search ..... 84/453, 181, 183, 84/267, 310, 311, 327, 290, 291, 292, 274, 275, 276, 277, 278, 279, 280, 281, 282, 283

(56) References Cited

U.S. PATENT DOCUMENTS

| | | | | |
|---|---|---|---|---|
| 633,776 | * | 9/1899 | Albert | 84/290 |
| 3,128,664 | * | 4/1964 | Bango | 84/329 |
| 3,877,501 | | 4/1975 | Toth | 150/52 R |
| 4,121,494 | | 10/1978 | Reno et al. | 84/453 |
| 5,363,734 | * | 11/1994 | Wilenken | 84/327 |

FOREIGN PATENT DOCUMENTS

| | | | | |
|---|---|---|---|---|
| 103591 | * | 6/1926 | (AT) . | |
| 58857 | | 3/1891 | (DE) | 84/453 |
| 357922 | * | 7/1920 | (DE) . | |
| 8909306 | | 9/1989 | (DE) . | |
| 9212050 | | 2/1993 | (DE) . | |
| 29519257 | | 3/1996 | (DE) . | |
| 0279720 | | 8/1988 | (EP) . | |
| 0332063 | | 3/1989 | (EP) . | |
| 625079 | * | 6/1949 | (GB) . | |

OTHER PUBLICATIONS

Margrave, W.: " in Footsteps of Stradivarius." The Evening Star, Washington, D.C., p. C–8, Apr. 23, 1971.*

* cited by examiner

*Primary Examiner*—David Martin
*Assistant Examiner*—Kim Lockett
(74) *Attorney, Agent, or Firm*—Collard & Roe, P.C.

(57) ABSTRACT

A protective cover for use with a stringed musical instrument comprises a roof-like shaped shield body attachable to the stringed instrument to protect the most sensitive parts and areas at and around the vertically mounted bridge, the string combination and other parts attached to the body of the instrument. The shield body has a concave bottom side and an inner string channel open to the bottom side and designed to accomodate the bridge and the strings. The shield body is made of elastically deformable material and has on its sligtly arched bottom side within an intermediate zone thereof locking projections designed to engage instrument recesses and projections, the latter being formed e.g. by a fingerboard end portion an the space therebelow. At both of its end portions the shield body is equipped with claw-like fixing projections designed to engage the instrument body at its neckside edge area and at its opposed edge area in a mounted position, the latter being reached by pressing vertically upon a intermediate portion of the shield body and simultaneously applying longitudinally directed forces, thereby causing a movement of the locking projections and of the fixing projections into their form-locking positions. Physical loads (shocks, vibrations etc.) are absorbed by the shield body and—due to its arched construction—guided to the robust neck-side edge and lower edge area of the instrument body.

20 Claims, 7 Drawing Sheets

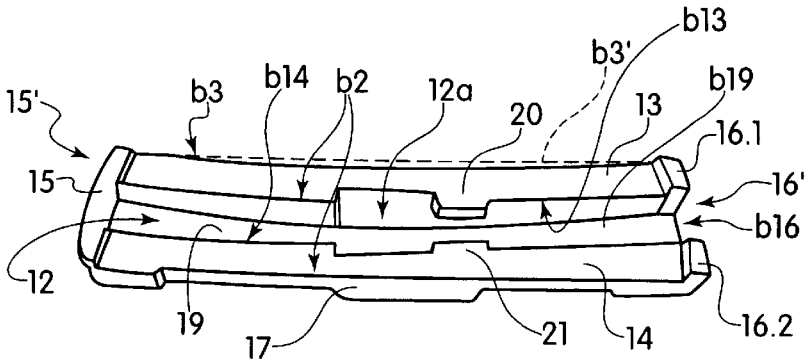
Fig. 5
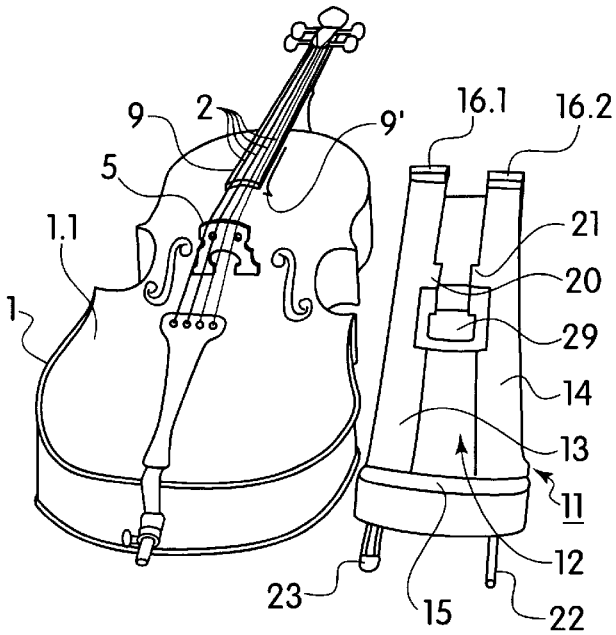
Fig. 6
Fig. 7
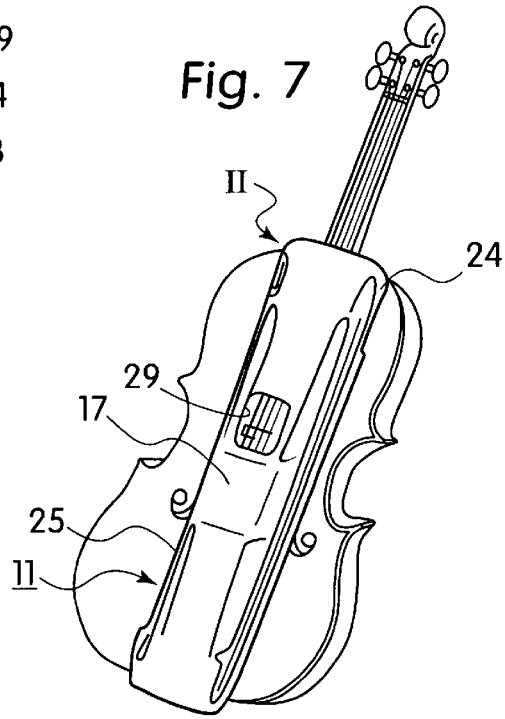

PROTECTIVE COVER FOR USE WITH A STRINGED MUSICAL INSTRUMENT

BACKGROUND OF THE INVENTION

1. Field of the Invention

The present invention relates in general to a protective cover for use with a stringed musical instrument, the latter having an instrument body, a neck and impact- and shock-sensitive parts located on said instrument body and said neck, said sensitive parts being at least formed by the strings and by a bridge supporting said strings. Such sensitive parts also can be e.g. piezo-electric pickups, magnetic pickups and tremolos of acoustic or electric guitars.

2. Background Discussion

At the present time, the prior art shows different protective covers that, however, do not give full protection to the above mentioned sensitive parts. The German patent No. 58857 shows a textile strip which can be installed to cover the strings of a violine along the finger board area. This textile strip does not protect the bridge when the violine is put into or taken out of an instrument case, nor does it protect the bridge during transportation of the violine when the case and the violine in it are subject to impacts, shocks or vibrations. As the bridge exceeds the level of the front side and is sometimes fastened to the front side of the instrument only by the tension of the strings, the bridge can be subject to physical attacks and damages during transport.

OBJECTS OF THE INVENTION

It is a general object of the invention to provide an improved protective cover for use with a stringed musical instrument that may readily be applied to protect the most sensitive parts and areas located on the front side of the instrument body including the strings and the bridge. Another object of the invention is to provide an improved protective cover that can be equipped with a protecting shelter space to store and transport the highly sensitive bows of the violin family, i.e. of violins, violas, violincelli and double basses.

A further object of the invention is to provide an improved protective cover for use with stringed musical instruments that have sensitive parts not only in the form of strings and bridges but also in the form of piezo-electric pickups, magnetic pick ups, preamplifiers, or tremolos, i.e. for use with acoustic and electric guitars.

SUMMARY OF THE INVENTION

The present invention relates to a protective cover for use with a stringed musical instrument, the latter having an instrument body, a neck, and impact- and shock-sensitive parts located on said instrument body and said neck, said sensitive parts being at least formed by the strings and by a bridge supporting said strings at a string supporting line at the front side of the instrument body, said string-supporting line forming the highest line of elevation relative to the front side of the instrument body as compared to the adjacent portions of the strings, said strings and said bridge defining a substantially rectangled zone within the front side area of the instrument body, the instrument body having an upper edge area adjacent said neck, a lower edge area opposite its upper edge area and instrument recesses and projections located adjacent to each other within the area of the front side of the instrument body.

The protective cover comprises a roof-like shaped shield body adapted to cover said substantially rectangled zone.

The shield body has a roof portion with a substantially convex contour on the top side thereof, a substantially concave contour on its bottom side, and an inner string channel open to the bottom side. Said inner string channel forms a housing space for the strings and the bridge, when the shield body is mounted, and is defined on its upper side by an inner wall of said roof portion. Lateral wall portions of the shield body have opposed lateral flanks and define said inner string channel by both of its lateral flanks. The inner wall of the roof portion and the lateral wall portions of the inner string channel accomodate the strings as to their ascending and descending course, respectively. Fixing projections are arranged at the neck-side end and at the lower end of the shield body adapted to engage the upper and lower edge areas of the instrument body, respectively, and thereby fix the shield body, when mounted on the front side of the instrument body, against longitudinal movement.

The protective cover furthermore comprises locking means for locking the shield body in its mounted position. To the locking means belong locking projections projecting from the lateral wall portions of the shield body, suitable to engage the instrument projections. Said locking means further comprise an elastic deformability of the shield body in order to have squeezed the bottom side of the shield body onto the front side of the instrument body when applying substantially vertical directed forces upon the roof portion, thereby permitting a sliding motion of said locking projections from a premounting position into said mounted position, according to which the locking projections grip under the instrument projections, as well as having moved the fixing projections into their fixing position to engage the upper and the lower edge areas of the instrument body when simulteanously applying a longitudinally directed displacement force upon the shield body.

According to a further embodiment of the invention a window opening is provided within the roof portion of the shield body adjacent the apex area and at a side therof which faces the neck-side end. The window opening is adapted to observe therethrough the position of the locking projections which they assume in said premounting and mounted positions of the shield body and to form a handle in cooperation with the adjacent portion of the apex area and the roof portion.

According to astill further embodiment of the invention the shield body at least at one longitudinally extending side of its roof portion has an adherent trough-like base extending from the neck-side end to the lower end of the shield body, this base having a groove to embed an instrument bow therein. Preferably, the groove of the trough-like base has resilient walls adapted to fix said embedded instrument bow by elastic deformation. It is also preferred, that at each of the longitudinally extending sides of the roof portion there is provided an adherent trough-like base and that each of the two bases have a groove to accomodate one instrument bow, respectively.

According to the invention it is possible to protect the sensitive parts, especially the strings and the bridge, of a violoncello, a double bass, a viola, or a violine. With slight alterations of the shield body it is possible to match the special needs of protection in respect to acoustic guitars (with and without piezoelectric pickups) and to electric or solid body guitars having in addition to their strings and bridges piezoelectric and/or magnetic pickups and tremolos.

BRIEF DESCRIPTION OF THE DRAWINGS

Various other objects and advantages of the invention will hereinafter become more fully apparent from the following description of the drawings illustrating presently preferred embodiments thereof and together with the discription serve to explain the principles of the invention, wherein;

FIG. 5 is a perspective view of the shield body upside down;

FIG. 6 is a perspective view of the shield body resting upside down besides the cello;

FIG. 7 is a perspective view in a reduced scale of the cello according to FIG. 1 with the shield-body in its mounted position;

DETAILED DESCRIPTION OF THE PREFERRED EMBODIMENTS

Figure 14:
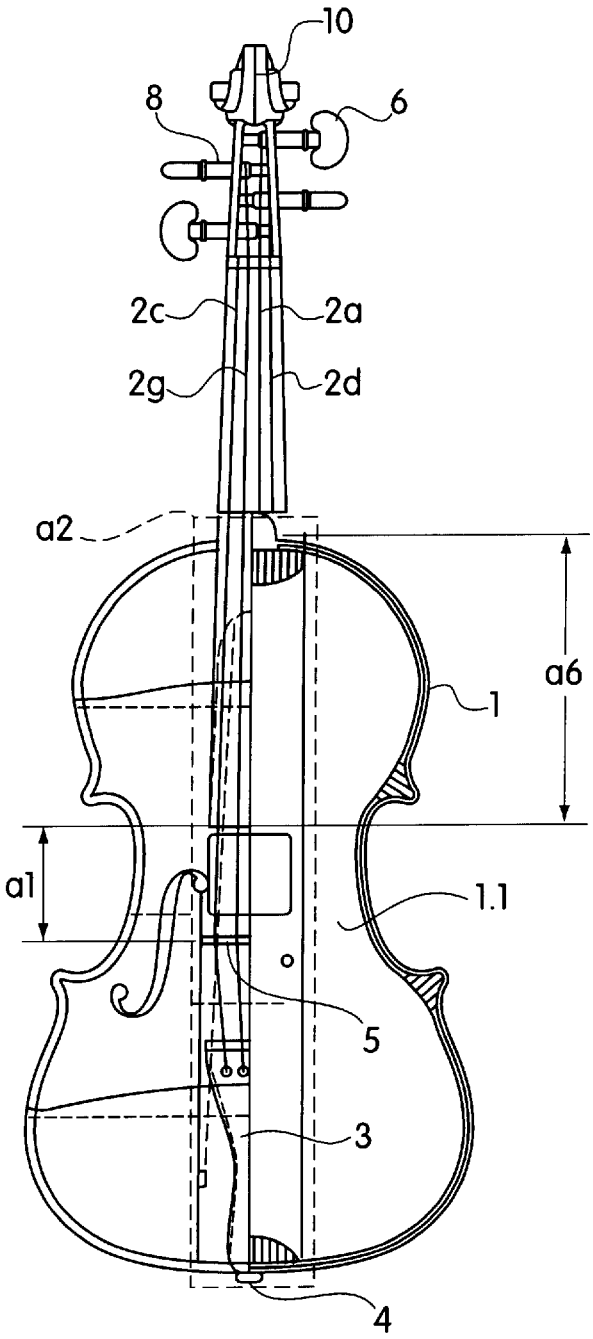
Fig. 14 (Prior Art)
Figure 15:
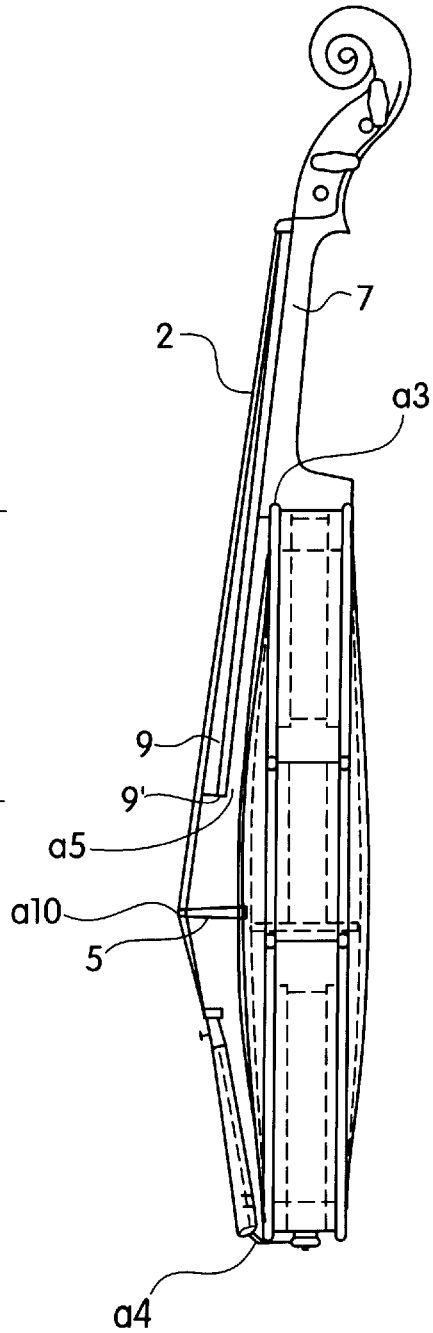
Fig. 15 (Prior Art)

Referring more specifically to the drawings and at first with reference to FIG. 14 and FIG. 15 there is shown a cello C representing an example for a stringed musical instrument to be protected. The cello C has an instrument body 1, a neck 7, and impact- and shock-sensitive parts located on the instrument body 1 and the neck 7. The sensitive parts are formed by the strings 2 and by a bridge 5 supporting strings 2 at string supporting line a1 at the front side of the instrument body 1. The string-supporting line a10 forms the highest line of elevation relative to the front side 1.1 of the instrument body 1 as compared to the adjacent portions of the strings 2. The strings 2 and the bridge 5 define a substantially rectangled zone a2 (depicted by dotted lines) within the front side area of the instrument 1 body. The instrument 1 body has an upper edge area a3 adjacent the neck 7, a lower edge area a4 opposite its upper edge area a3 and instrument recesses a5 and projections 9, 9' located adjacent to each other within the area of the front side 1' of the instrument body 1 and hereinafter referred to as finger board 9 and interface 9' of finger board 9, respectively.

The strings comprise a string combination of four strings, namely 2*c*, 2*g*, 2*d* and 2*a*, which is installed on the instrument body 1. The strings 2 are fixed at one end to the tailpiece 3 and extend over the bridge 5 to the threads 8 of the pegs 6, to which the other ends of the strings 2 are tensionably fixed. The tailpiece 3 is anchored at the endbutton 4 and rests with its foot on the lower edge a4 of the instrument body 1. Below of and spaced to the strings 2 as well as spaced to the front side 1.1 there extends the finger board 9 from the neck 7 along a first distance a6 almost to the middle of the front side 1.1 of the instrument body 1, terminating with a second distance a1 with respect to the bridge 5. The strings 2 extend from the tailpiece 3 ascending, i.e. with increasing vertical distance with respect to the front side 1.1, reaching their point of culmination at the supporting line a10 of the bridge 5 and then descending, i.e. with decreasing vertical distance with respect to the front side 1.1, following the finger board 9 up to the threads 8 of the pegs 6, the latter being located between the end of the neck 7 and the scroll 10. The fixing of the bridge 5 standing up vertically from the front side 1.1. is secured solely by the tension of the strings 2 tightened from the tailpiece (3) to the pegs (6). This renders the sensitive parts 5 and 2 and the area around the bridge 5 extremely injurable by even the slightest physical violence, especially during transportation, as the effect of any such violence results unavoidably in hitting the bridge 5, its foot portion and the surrounding area.

Referring now to FIGS. 1–5, one can see that according to the invention the instrument body 1 is shielded against the aforementioned effects of any occuring physical violence guiding the impacts and shock forces to the stable upper and lower edge areas of the the instrument body 1. To this end, the protective cover comprises a roof-like shaped shield body 11 that is, according to FIGS. 1 to 7 superimposed or put over the rectangled zone a2 of the front side 1.1 of the instrument body 1 where the sensitive parts 5, 2 are located, and is secured thereto prefarably by form-locking.

Figure 3:
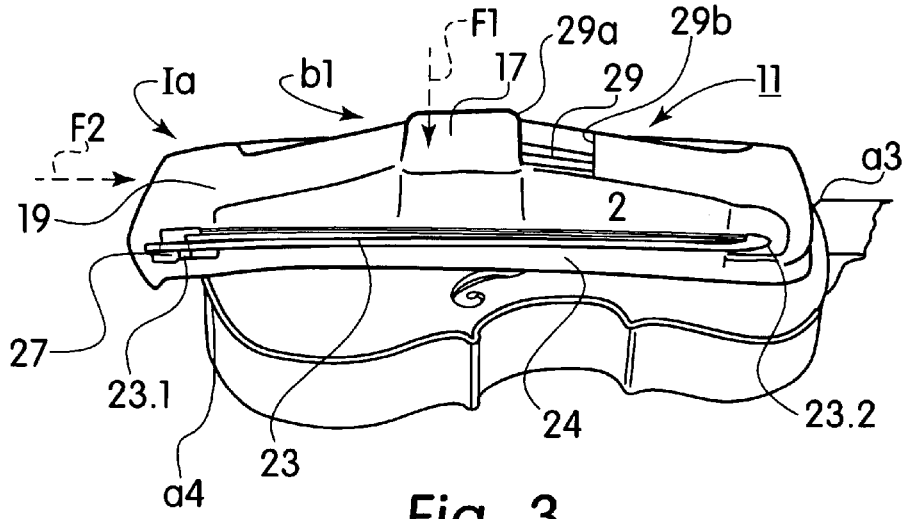
FIG. 3 is a perspective view of the cello body top showing the shield body of the protective cover in a premounting position, i.e. not yet fully attached to the instrument body.

The roof-like shaped shield body 11 (hereinafter briefly called shield body) is adapted to cover the substantially rectangled zone a2 (FIG. 1) and has a top side b1, a bottom side b2, a neck-side end 16' and a lower end 15' opposite said neck-side end 16' (see FIGS. 3 to 5). The shield body 11 furthermore has a roof portion 19 with a substantially convex contour on the top side b1 thereof, a substantially concave contour b3 on its bottom side b2 as can be seen in FIG. 5 when one compares the straight dottet line b3' with the contour line b3, and an inner string channel 12 open to said bottom side b2. The inner string channel 12 forms a housing space for the strings 2 and the bridge 5, when the shield body 11 is mounted (see mounted position II in FIG. 4) and is defined on its upper side by an inner wall b19 of the roof portion 19.

The lateral wall portions 13, 14 of the shield body 11 have opposed lateral flanks b13, b14 (FIG. 5) and define the inner string channel 12 by both of its lateral flanks b13, b14 and by its bottom sides b2, b2 that also represent the bottom side of the shield body 11 and hence are concavely contoured or arched (b3). The inner wall b19 of the roof portion 19 and the lateral wall portions 13, 14 of the inner string channel 12 accomodate the strings 2 as to their ascending and descending course, respectively. First fixing projections 16.1, 16.2 are arranged at the neck-side end 16' of the shield body 11 and a second fixing projection 15 is provided at the lower end 15' of the shield body 11, adapted to engage said upper and lower edge areas a3, a4 of the instrument body 1, respectively, (compare FIG. 2) and thereby fix the shield body 11, when mounted on the front side 1' of the instrument body 1, against longitudinal movement (see mounted position II in FIGS. 1, 2, and 4). As best can be seen out of FIGS. 2 and 5, the fixing projections 16.1, 16.2 and 15 are formed as angled jaws designed to grip over the upper and lower edge areas a3, a4 of the instrument body 11. The fixing projection 15 is in one piece whereas there are two fixing projections 16.1, 16.2 with an intermediate space b16 in between to accomodate the adjacent portion of the neck 7.

The locking means for locking the shield body 11 in its mounted position II comprise locking projections 20, 21 (see FIG. 5) projecting from the lateral wall portions 13, 14 into a portion of the inner string chanel 12. The locking projections 20,21 are designed to engage the instrument projections 9, 9', i.e. the interface 9' and the adjacent portions of the finger board 9. The locking means further comprises an elastic deformability of the shield body 11 in order to have squeezed the bottom side b2 of the shield body 11 onto the front side 1' of the instrument body 1 when applying substantially vertical directed forces F1 on the roof portion 19, as is depicted by dotted lines in FIG. 3, thereby permitting a sliding motion of the locking projections 20, 21 from the premounting position Ia into the mounted position II, as is depicted in FIG. 4, according to which the locking projections 20, 21 grip under the instrument projections 9, 9' into the recess a5 provided below the finger board 9 (compare FIG. 2). The sliding motion is caused by applying a longitudinally directed displacement force F2 (see dotted lines in FIG. 3). During this sliding motion the fixing projections 16.1, 16.2 and 15 simultaneously are moved into their fixing position to engage the upper and the lower edge areas a3, a4 of the instrument body 1.

Preferably, the shield body 11 is made of elastically deformable plastic material. A favored plastic material in this connection is extruded polypropylen (EPP). As can been seen in FIGS. 2 to 4, the shield body 11 has an apex area 17 surrounding and accomodating with its inner space the bridge 5 and portions of the strings 2 neighboring the bridge 5. In connection therewith, the roof portion 19 and the lateral wall portions 13, 14 are tapered along the distance between the apex area 17 and the neck-side end 16' as well as the lower end 15', respectively, of the shield body 11. It is advantageous to provide a window opening 29 within the roof portion 19 of the shield body 11 and adjacent the apex area 17 at one side therof which faces the neck-side end 16'. The window opening 29 is adapted to observe therethrough the locking projections 20, 21 in the premounting and mounted positions Ia, II of the shield body 11 and to form handles by the edges 29*a*, 29*b* of the window opening 29, i.e. together with the adjacent portions of the apex area and the roof portion 19 (see FIGS. 3 and 4).

The arched construction of the shield body guarantees a complete relieving of the front side 1.1 of the cello C from the effects of physical loads possibly attacking the area around the bridge 5 of the instrument C. The construction and the use of elastically deformable material offers the possibility of transferring the effects of physical loads to the resting points (15, 16.1, 16.2) at the edges a3, a4 of the instrument similar to putting a shell constructed bridge on its pylons. The shield body 11 is constructed in a way to protect the complete vulnerable portions on the front side 1.1 along the strings 2. FIG. 5 shows the inner string channel 12 in an upside down position of the shield body 11. The inner string channel 12 follows the ascending and descending course of the strings 2 all the way from the tailpiece 3 over the bridge 5 down to the upper edge area a3 of the front side 1.1 of the instrument body 1. Due to the shell construction of the shield body 11 the lateral wall portions 13, 14 (acting as protective flanks) on both sides of the inner string channel 12 form an elastical balance along the front side 1.1, resting only with their neck-side and lower ends 16', 15' and jaw-like-projections 15, 16.1, 16.2 on the upper and lower edge areas a3, a4 of the front side 1.1 and the instrument body 1.

The height of the locking projections 20, 21 projecting from the lateral wall portions 13, 14 or lateral flanks b13, b14 corresponds exactly to the vertical distance between the lower end of the fingerboard 9 and the front side 1.1. The distance between the locking projections 20, 21 below the window opening 29 corresponds exactly to the cross dimension of the string combination 2 which is slightly shorter than the width of the lower end of the fingerboard 9. Due to this fact the shield body 11 can easily be lowered vertically onto the instrument body 1 letting the string combination pass between the locking projections 20, 21 within the area of the gap a1. When pushing the shield body 11 towards the upper edge area a3 the instrument body 1—see movement of the shield body 11 in FIGS. 3 and 4—the locking projections 20, 21 slip under the fingerboard (9) creating a firmly secured unit of the instrument body 1 and the shield body 11.

As soon as the shield body reaches the upper and lower edg areas a3, a4 of the instrument body the the fixing projections 15, 16.1, 16.2 softly clickshut with the edge areas a3, a4. The distance between the neck-side end and the lower end 16', 15' of the shield body corresponds exactly to the dimension of the front side 1.1 of the instrument body 1. The shield body 11 is firmly fixed onto both ends of the instrument body 1, and along the front side 1.1 it is held firmly by the locking projections 20, 21 under the fingerboard 9.

In the fixed position II (see FIG. 4) the shield body 11 rests on three points of the instrument body 1: The upper and lower edge areas a3, a4, and by the locking projections 20, 21 it is fixed under the stable fingerboard 9, thus obtaining a maximum protection of the front side 1.1 which—except for the upper and lower edge areas a3, a4—is not being touched at all by the elastic shield body, thereby granting very good damping characteristics to the protective cover including the shield body. Since the shield body 11 in its mounted position II is elastically pretensioned, it cannot be loosened unintentionally. In order to demount the shield body on has to perform the described locking actions in a reverse sequence, i.e. unlocking the fixing projections 16.1, 16.2, when applying the pressing force F1 (FIG. 3) and simultaneously applying a longitudinal force opposed to the force F2.

Figure 1:
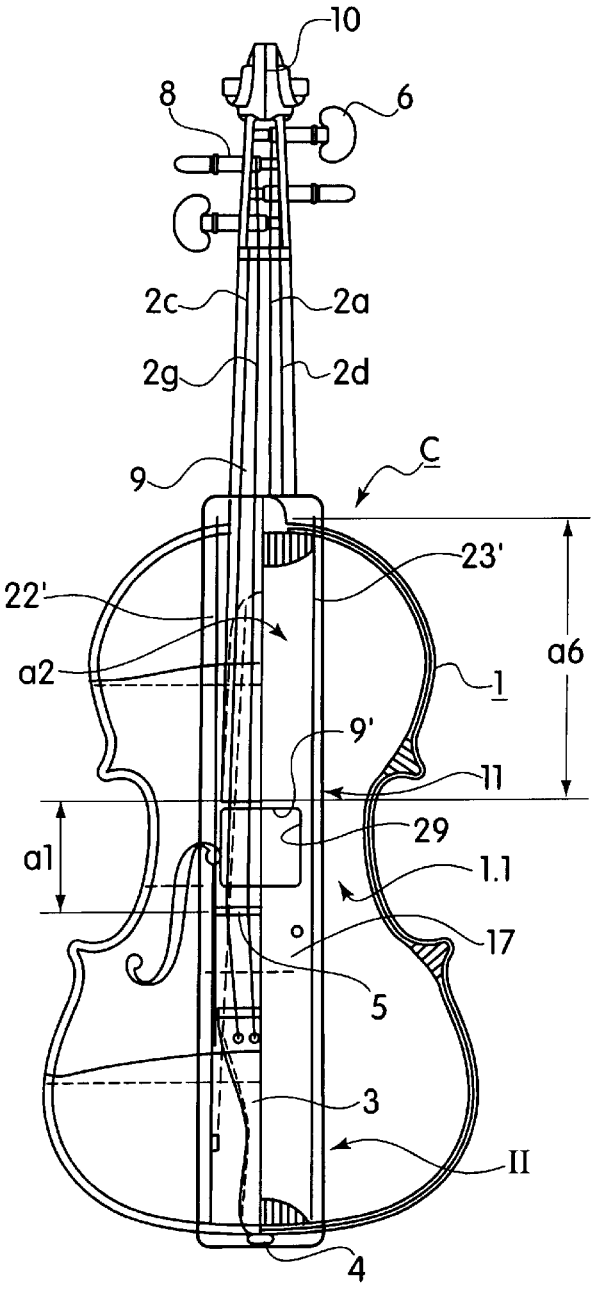
FIG. 1 is a plan view of a violoncello in upright position (hereinafter briefly called cello) showing the protective cover having a roof-like shaped shield body installed at the front side of the cello, the left half of the shield body being shown transparently for the sake of better understanding.
Figure 2:
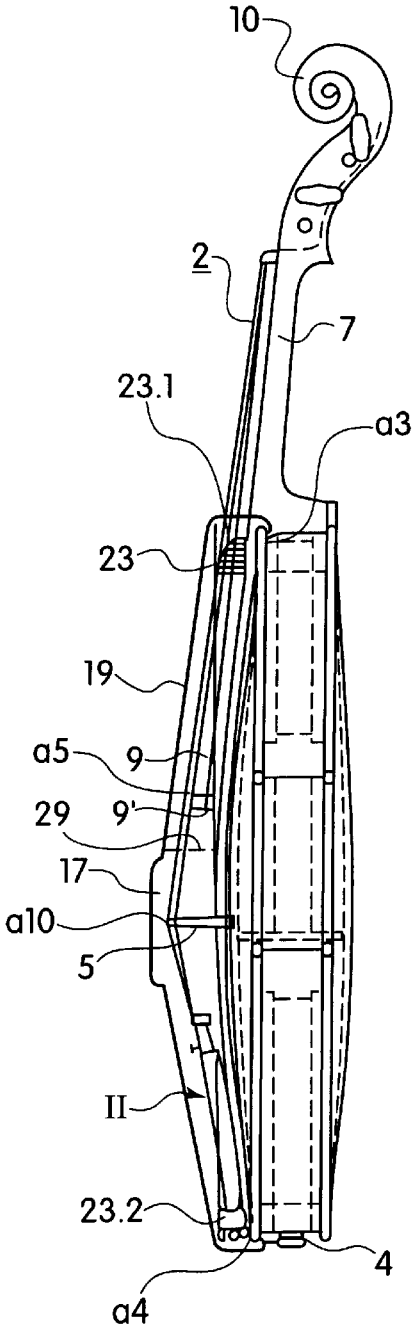
FIG. 2 is a side elevational view of the cello of FIG. 1 showing the shield body as being transparent, too.

The shield body 11 at least at one longitudinally extending side of its roof portion 19, preferably on both of said sides, has an adherent trough-like base 24, 25 extending from the neck-side end 16' to its lower end 15' of said shield body. Each of these bases 24, 25 have a groove 27 within the area of base enforcements 26 to embed an instrument bow 22, 23 therein, i.e. tip and frog 23.1, 23.2, thereof. To this end, the grooves of the trough-like bases have resilient walls adapted to fix the embedded instrument bows by elastic deformation or snap action (see FIGS. 1 to 4). Hence the bows are safely stored on the shield body 11 and fully protected against physical loads during transportation. In FIGS. 1 and 2 the bows 22, 23 are depicted schematically by black fat lines.

Figure 4:
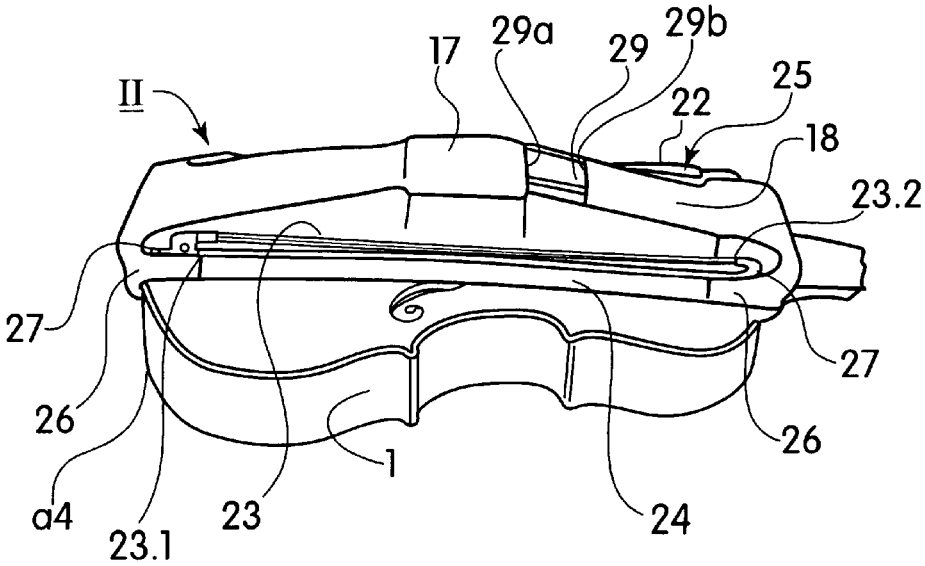
FIG. 4. is the same view as in FIG. 3 but showing the shield body of the protective cover in its mounted position, i.e. completely fixed to the front side of the instrument.
Figure 8:
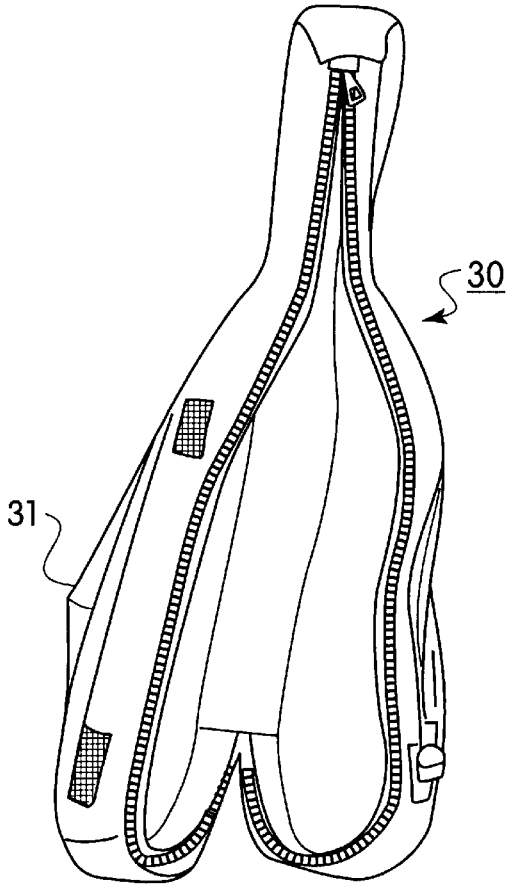
FIG. 8 is a perspective view of an opened and yet empty instrument carrying bag designed to match a cello having an attached shield body as depicted in FIG. 7.
Figure 9:
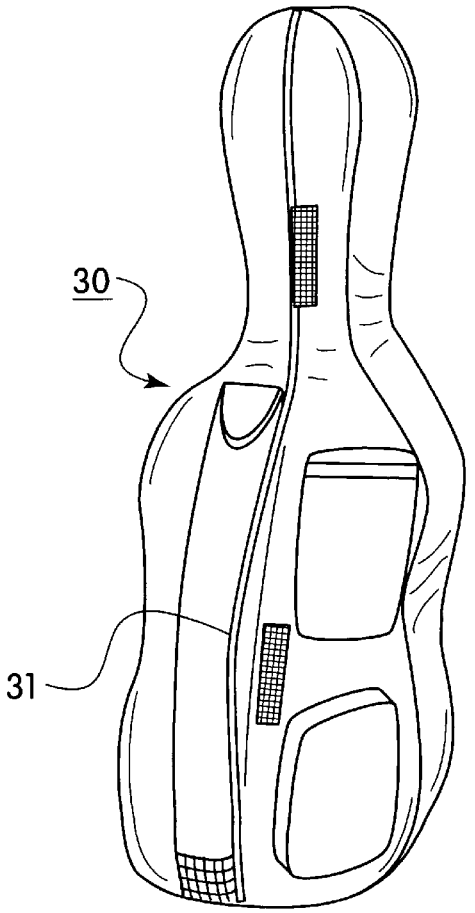
FIG. 9 is a perspective view of the bag according to FIG. 8, but closed and containing the cello with the attached shield body inside.

In the state of the mounted position II according to FIGS. 4 and 7, the cello C together with the mounted shield body 11 can be inserted into a suitable instrumental bag 30 (FIGS. 8 and 9). FIG. 8 shows the opened bag 30 having a enlarged projecting or convex portion 3 1 on its front side, said portion 31 accomodating the form and the volume of the shield body 11. FIG. 9 shows the bag 30 having the cello C together with the attached shield body 11 in its inside. Therefor the cavity of the portion 31 is filled by the shield body, and the portion projects in the form of an elevation or bulb. FIGS. 8 and 9 show, that by the bag 30 the protective cover of the cello C is completed and that by taking the cello C out of the bag 30 or putting it into the bag no harm will be done to the sensitive parts 5, 2 of the cello C, neither during transport because of the protection that is granted to the cello C or generally to the stringed musical instrument by the shield body 11 and the bag 30.

The protective cover comprising the shield body 11 is not only applicable to the cello C shown, but also to double basses, violas, or violines—e.g. to the violine family, all of those instruments having exposed bridges an strings supported by the bridges. Of course, the size of the shield body has to be adapted to the size of the stringed musical instrument to be protected. Furtermore, the shield body can be used—with slight alterations—with an acoustic guitar (FIGS. 10 and 11) and with an electric or solid body guitar (FIGS. 12 and 13).

Figure 10:
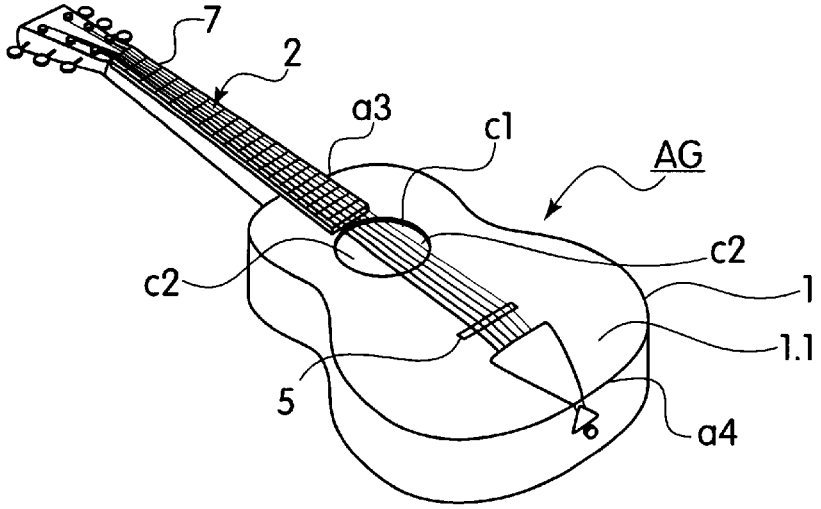
FIG. 10 is a perspective simplified view of an acoustic guitar belonging to a second embodiment.
Figure 11:
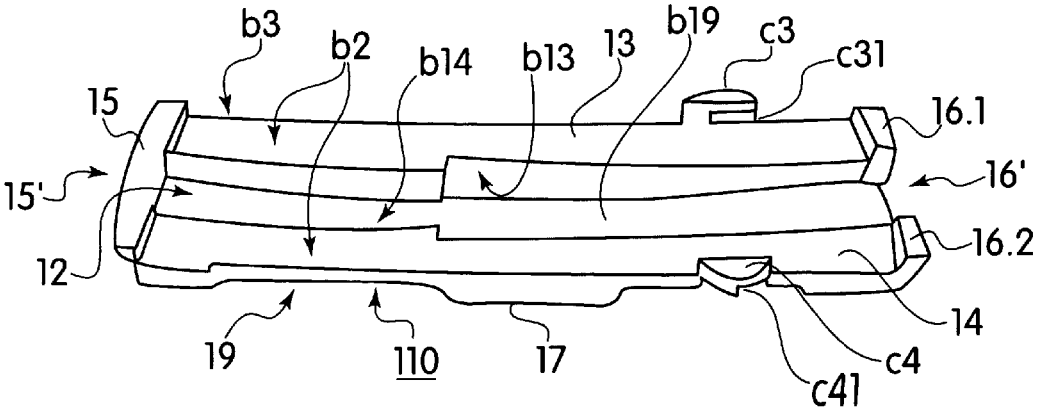
FIG. 11 is a perspective view of a shield body in an upside-down position, suitable to be fixed to the guitar of FIG. 10.

FIG. 10 shows an acoustic guitar AG with a usually circular sound aperture c1 overlying the strings 2 on both sides thereof. Thereby segmental partial openings c2 are accessible from above. As can be seen from FIG. 11, the locking projections c3 and c4 of the shield body 110 (which is depicted in an enlarged scale as compared to the guitar AG of FIG. 10) are adapted to fit into the segmental partial openings c2, c1, respectively, when the shield body 110 is put into a premounting position. The locking projections c3 and c4 have recesses c31, c41, respectively, so that they can be moved to grip under the front side wall 1.1 adjacent the rim of the sound aperture when applying the vertically and longitundinally directed forces (see arrows F1 and F2 in FIG. 3) upon the shield body 110.

Figure 12:
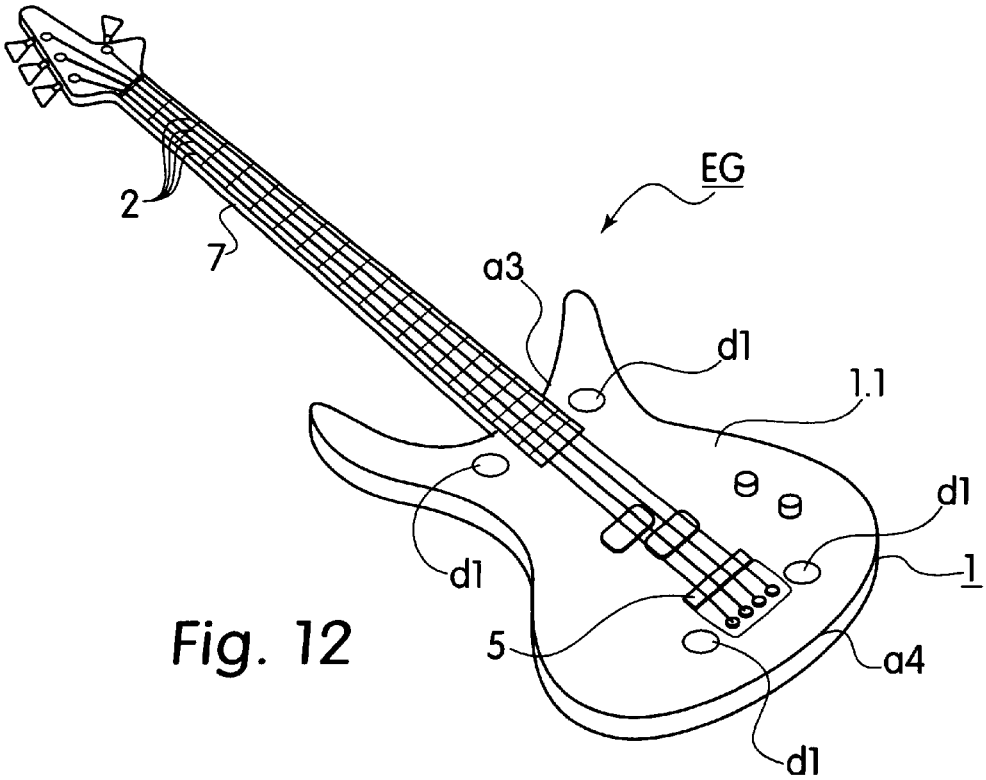
FIG. 12 is a perspective simplified view of an electric guitar belonging to a third embodiment.
Figure 13:
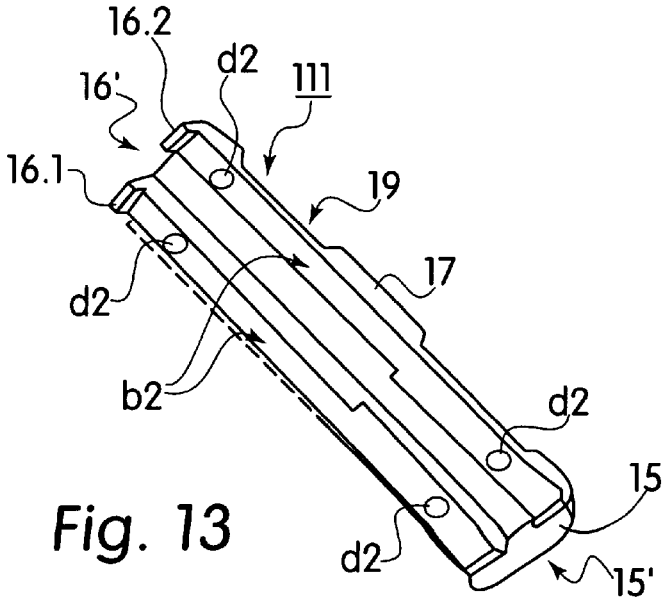
FIG. 13 is a perspective view of an modified shield body in an upside-down position, suitable to protect the guitar of FIG. 12, and FIGS. 14 and 15 show a prior art violoncello, depicted according to FIGS. 1 and 2, respectively, but without the protective cover.

To the electric guitar EG of FIG. 12 belongs also a slightly modified shield body 111 which is depicted in an enlarged scale as compared to the guitar EG of FIG. 12. The locking means for locking the shield body in its mounted position here comprises a first adhesive lining d1 located and fixed at a first spot areas on the front side 1.1 of the instrument body 1 within the area covered by the shield body 111 of FIG. 13 in its mounted position. The locking means comprises, a second adhesive lining d2 located and fixed at second spot areas on the bottom side b2 of the shield body 111. The first and said second spot areas coincide and stick together with their adhesive linings d1, d2 when the shield body 111 is in its mounted position. The first and said second adhesive linings d1, d2 preferably are formed by ferromagnetic armature inserts and corresponding permanent magnet inserts, respectively (not shown in detail). It is also preferred, that the shield bodies 110 and 111 of FIGS. 11 and 13 have the concave or arched bottom side configuration as described with respect to the first embodiment. This facilitates the mounting and gives better protection to the sensitive parts—bridges 5, strings 2, magnetic pickups d3 (FIG. 12) or a piezoelectric pickup integrated in the bridge of guitar AG (FIG. 10). Together with the arched bottom side configuration, the mounted position of the embodiment of FIGS. 12, 13 is reached also when applying the forces F1 and F2 (FIG. 3) upon the shield body 111, the armatures d1 and the permanent magnets d2 snapping and sticking together at the end of this mounting procedure.

Modifications and changes are contemplated without departing from function or scope of the invention.

I claim:

1. A protective cover for use with a stringed musical instrument, the latter having an instrument body, a neck and impact- and shock-sensitive parts located on said instrument body and said neck, said sensitive parts being at least formed by the strings and by a bridge supporting said strings at a string supporting line at the front side of said instrument body, said string-supporting line forming the highest line of elevation relative to the front side of said instrument body as compared to the adjacent portions of the strings, said strings and said bridge defining a substantially rectangled zone within the front side area of said instrument body, said instrument body having an upper edge area adjacent said neck, a lower edge area opposite its upper edge area and instrument recesses and projections located adjacent to each other within the area of said front side of said instrument body, comprising:

a roof-like shaped shield body adapted to cover said substantially rectangled zone, said shield body having a top side, a bottom side, a neck-side end and a lower end opposite said neck-side end, said shield body further having a roof portion with a substantially convex contour on the top side thereof, a substantially concave contour on its bottom side, and an inner string channel open to said bottom side, said inner string channel forming a housing space for the strings and the bridge, when said shield body is mounted, and being defined on its upper side by an inner wall of said roof portion, lateral wall portions of said shield body having opposed lateral flanks and defining said inner string channel by both of its lateral flanks, each of said lateral wall portions having a bottom side, each of the bottom sides of said lateral wall portions being concavely contoured to form said concave contour of the bottom side of said shield body, said inner wall of said roof portion and said lateral wall portions of said inner string channel accommodating the strings as to their ascending and descending course, respectively, fixing projections arranged at the neck-side end and at the lower end of said shield body adapted to engage said upper and lower edge areas of said instrument body, respectively, and thereby fix said shield body, when mounted on the front side of said instrument body, against longitudinal movement, locking means for locking said shield body in its mounted position, comprising locking projections projecting from said lateral wall portions, adapted to engage said instrument projections, said shield body being made of elastically deformable material to permit squeezing of the bottom side of said shield body onto the front side of said instrument body when applying substantially vertical directed forces on said roof portion, thereby permitting a sliding motion of said locking projections from a premounting position into said mounted position according to which said locking projections grip under said instrument projections as well as having moved said fixing projections into their fixing position to engage said upper and said lower edge areas of said instrument body when simultaneously applying a longitudinally directed displacement force upon said shield body.

2. The protective cover of claim 1, wherein said shield body has an apex area surrounding said bridge and portions of said strings neighboring said bridge, said roof portion and said lateral wall portions being tapered along the distance between said apex area and said neck-side end as well as said lower end, respectively, of said shield body.

3. The protective cover of claim 1, wherein said musical instrument has a finger board being attached to said neck and extending over a first distance into said rectangled zone under and spaced from said strings as well as above and spaced from the front side of said instrument body, said first distance being terminated by an interface of an end portion of said finger board which is spaced from said bridge by a second distance, said end portion of said finger board forming said instrument projections, said locking projections being located within said second distance when said shield body is in its said premounting position, whereby said sliding motion of said locking projections causes the latter to grip under said finger board end portion.

4. The protective cover of claim 2, wherein a window opening is provided within said roof portion of said shield body adjacent said apex area and at a side therof which faces said neck-side end, said window opening being adapted to observe said locking projections in said premounting and mounted positions of said shield body and to form a handle together with the adjacent portion of said apex area and said roof portion.

5. The protective cover of claim 1, wherein said shield body is adapted to the size of a violoncello.

6. The protective cover of claim 1, wherein said shield body is adapted to the size of a double bass.

7. The protective cover of claim 1, wherein said music instrument is an acoustic guitar, the instrument body of which having a front side wall and a substantially circular sound aperture in the front side wall below said strings as well as front side wall portions adjacent said sound aperture, said sound aperture overlying said strings on both sides thereof, the overlying portions of said sound aperture forming segmental openings, said front side wall portions adjacent said segmental openings and said segmental openings itself representing said instrument projections and recesses, respectively, said locking projections of said shield body being adapted to be insertable into said segments when said shield body is being put in its premounting position and to grip under said instrument projections when said shield body is moved into its mounted position.

8. The protective cover of claim 1, wherein said shield body at least at one longitudinally extending side of its said roof portion has an adherent trough-like base extending from said neck-side end to said lower end of said shield body, said base having a groove to embed an instrument bow therein.

9. The protective cover of claim 8, wherein said groove of said trough-like base has resilient walls adapted to fix said embedded instrument bow by elastic deformation.

10. The protective cover of claim 8, wherein at each of said longitudinally extending sides of said roof portion there is provided an adherent trough-like base, each of said two bases having a groove to accomodate one instrument bow, respectively.

11. The protective cover of claim 1, wherein said shield body is made of elastically deformable plastic material.

12. The protective cover of claim 11, wherein said plastic material is extruded polypropylen (EPP).

13. A protective cover for use with a stringed musical instrument, the latter being a solid body guitar and having an instrument body, a neck and impact- and shock-sensitive parts located on said instrument body and said neck, said sensitive parts being at least formed by the strings and by a bridge supporting said strings at a string supporting line at the front side of said instrument body, said string-supporting line forming the highest line of elevation relative to the front side of said instrument body as compared to the adjacent portions of the strings, said strings and said bridge defining a substantially rectangled zone within the front side area of said instrument body, said instrument body having an upper edge area adjacent said neck and a lower edge area opposite its upper edge area, comprising:

a roof-like shaped shield body adapted to cover said substantially rectangled zone, said shield body having a top side, a bottom side, a neck-side end and a lower end opposite said neck-side end, said shield body further having a roof portion with a substantially convex contour on the top side thereof, and an inner string channel open to said bottom side, said inner string channel forming a housing space for the strings and the bridge, when said shield body is mounted, and being defined on its upper side by an inner wall of said roof portion, lateral wall portions of said shield body having opposed lateral flanks and defining said inner string channel by both of its lateral flanks, each of said lateral wall portions having a bottom side, said inner wall of said roof portion and said lateral wall portions of said inner string channel accommodating the strings as to their ascending and descending course, respectively, fixing projections arranged at the neck-side end and at the lower end of said shield body adapted to engage said upper and lower edge areas of said instrument body, respectively, and thereby fix said shield body, when mounted on the front said of said instrument body, against longitudinal movement, locking means for locking said shield body in its mounted position, comprising a first adhesive lining located and fixed at a first spot area on the front side of said instrument body within the area covered by said shield body in its mounted position, said locking means comprising a second adhesive lining located and fixed at a second spot area on the bottom side of said shield body, said first and said second spot areas coinciding and sticking together when said shield body is in its mounted position.

14. The protective cover of claim 13, wherein said first and said second adhesive lining of said locking means are formed by permanent magnet inserts and corresponding ferromagnetic armature inserts, respectively.

15. The protective cover of claim 13, wherein said bottom sides of said lateral wall portions of said shield body are concavely contoured and said second adhesive lining is installed at the bottom sides of said lateral wall portions, said shield body being made of an elastically deformable material and having a premounting position according to which said first and said second adhesive linings are spaced to each other, hence establishing a gap, said first and said second adhesive lining coming into contact and sticking together when said shield body is deformed by applying a substantially vertically directed force from the outside on said roof portion, thereby closing said gap and establishing said mounted position.

16. The protective cover of claim 13, wherein said ferromagnetic armature inserts are installed at the front side of said instrument body within said rectangled zone and said permanent magnet inserts are installed at the bottom sides of said lateral wall portions of said shield body.

17. The protective cover of claim 1, wherein said shield body is adapted to the size of a viola.

18. The protective cover of claim 1, wherein said shield body is adapted to the size of a violin.

19. A protective cover for a stringed musical instrument, comprising an elongated, roof-like shaped shield body which is made of a single piece of an elastically deformable plastic material, said shield body having a) a top side, b) a bottom side, c) a first end portion, d) a second end portion opposite said first end portion, e) an open string channel extended from said first end portion to said second end portion along said bottom side, said string channel e1) being defined by lateral wall portions having lateral flanks opposed to each other and e2) having a roof-like shape, f) a first fixing projection arranged on said first end portion, g) a second fixing projection arranged on said second end portion and h) first and second locking projections projecting from said lateral wall portions into a portion of said string channel and being arranged opposite each other.

20. The protective cover of claim 19, wherein said shield body has at least one groove for embedding an instrument bow therein.

* * * * *